United States Patent [19]

Franklin et al.

[11] Patent Number: 4,796,763

[45] Date of Patent: Jan. 10, 1989

[54] MODULAR DISPLAY

[75] Inventors: Robert P. Franklin, Lake Hopatcong; John LaRocca, Fairfield, both of N.J.

[73] Assignee: Trans-World Marketing Corporation, East Rutherford, N.J.

[21] Appl. No.: 942,525

[22] Filed: Dec. 16, 1986

[51] Int. Cl.[4] ..... A47F 3/14

[52] U.S. Cl. ..... 211/133; 211/194

[58] Field of Search ..... 211/133, 189, 194, 59.4, 211/188, 186; 312/107, 111, 137, 209, 11

[56] References Cited

U.S. PATENT DOCUMENTS

| | | | |
|---|---|---|---|
| 3,891,092 | 6/1975 | Surrette et al. | 211/13 |
| 4,534,473 | 8/1985 | Post | 211/186 X |
| 4,688,860 | 8/1987 | Accumanno et al. | 211/144 X |

FOREIGN PATENT DOCUMENTS

| | | | |
|---|---|---|---|
| 257870 | 10/1967 | Austria | 211/194 |
| 2132075 | 7/1984 | United Kingdom | 312/8 |

*Primary Examiner*—Reinaldo P. Machado
*Assistant Examiner*—Sarah A. Lechok Eley
*Attorney, Agent, or Firm*—Ostrolenk, Faber, Gerb & Soffen

[57] ABSTRACT

A plurality of factory constructed modules are user assembled to form a free standing display rack. Each module includes a pair of vertically aligned open front pans that are secured to an L-shaped frame constructed of rectangular tube elements. First and second modules are connected together to form a side-by-side array and a third module is connected to the array at right angles thereto. One end of the third module is adjacent the rear of the array and the open front of the third module is generally coplanar with a side of the array. A corner adapter interposed between the third module and the array includes a cover section that is generally coplanar with the front of the third module and bridges a narrow vertical gap between the front of the third module and array side adjacent thereto.

21 Claims, 5 Drawing Sheets

MODULAR DISPLAY

BACKGROUND OF THE INVENTION

This invention relates to display racks in general and more particularly relates to a modular construction for a free standing display.

Interlocking stackable bins in various arrangements are disclosed in U.S. Pat. No. 4,423,913 issued Jan. 3, 1984 to W. J. Lee for Display and Storage Assembly Utilizing a Plurality of Interchangeable Stackable Bins. The assemblies disclosed in this patent require the end user to engage in many assembly operations and the number of useful arrangements obtainable is extremely limited.

SUMMARY OF THE INVENTION

The instant invention utilizes modular construction techniques to achieve great flexibility in designing free standing display rack arrangements. As will hereinafter be seen, such arrangements include free standing islands as well as racks that are located at the ends of checkout counters in supermarkets where customer traffic is slowed down and concentrated.

In accordance with the instant invention a display stand is user assembled from a plurality of factory manufactured modules each of which includes two molded plastic pans stacked one above the other and held in this position by a metal frame. The latter is constructed of tubular members of rectangular cross-section. Two of these tubular numbers extend vertically along the rear of the module adjacent to the sides thereof and the lower ends of these members project forward to support the pans from below. In a typical arrangement two or more of these modules are connected in a side-by-side array and another module is connected to the array in a position where the open front of this last module is generally coplanar with one end of the array. Additional modules may be secured to this last module to form another side-by-side array.

As will hereinafter be seen, the modules may be arranged to form a so called island. In this type of arrangement the modules cooperate to completely enclose a central area over which a roof is placed. If the modules are arranged so as not to completely enclose an area, such area may still be provided with a roof and may also be provided with one or more storage shelves.

OBJECT OF THE INVENTION

Accordingly, the primary object of the instant invention is to provide a novel modular construction for display racks.

Another object is to provide a display rack comprising factory constructed modules that may readily be assembled with one another by the user.

Still another object is to provide a rack module that permits great flexibility in assembling a rack comprising a plurality of such modules.

BRIEF DESCRIPTION OF THE DRAWINGS

These objects as well as other objects of this invention shall become readily apparent after reading the following description of the accompanying drawings in which.

DETAILED DESCRIPTION OF THE PREFERRED EMBODIMENTS

Figure 1:
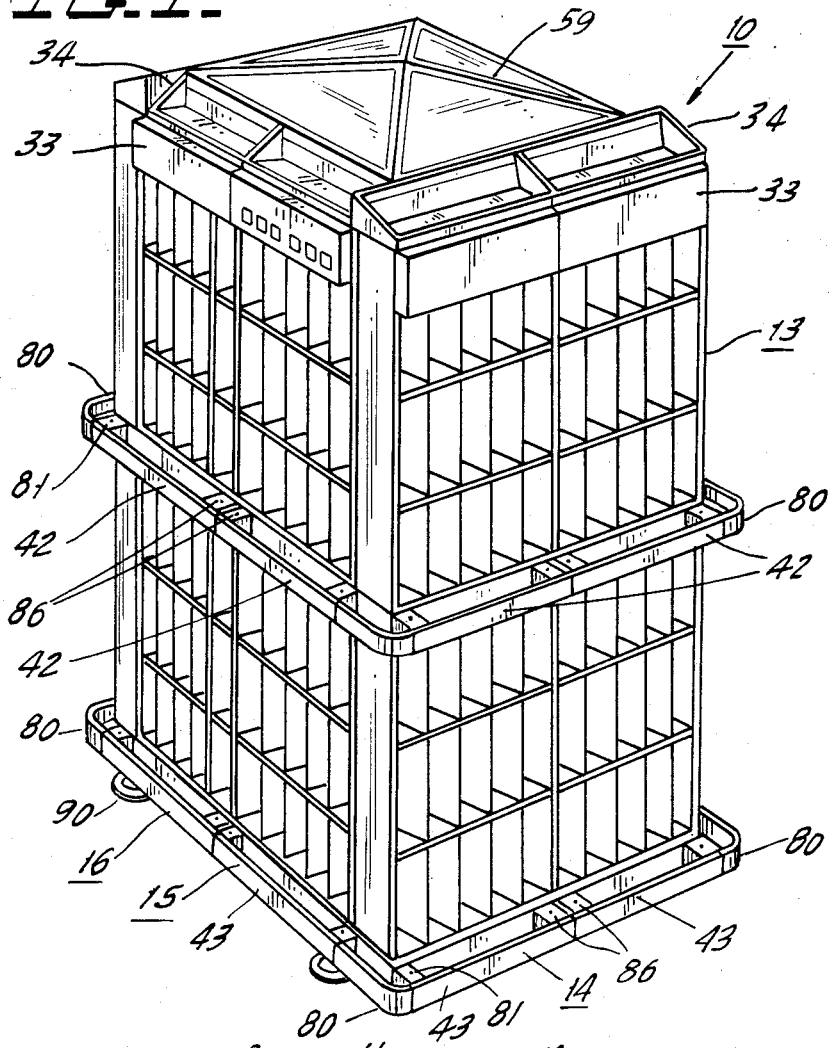
FIG. 1 is a perspective of an island type display stand constructed in accordance with teachings of the instant invention.
Figure 2:
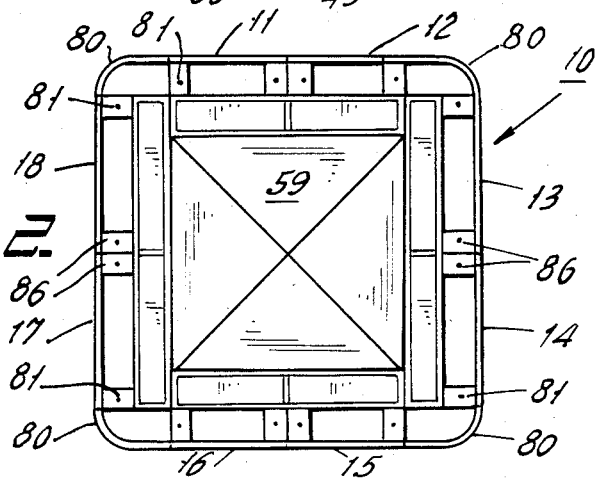
FIG. 2 is a plan view of the display stand of FIG. 1.
Figure 7:
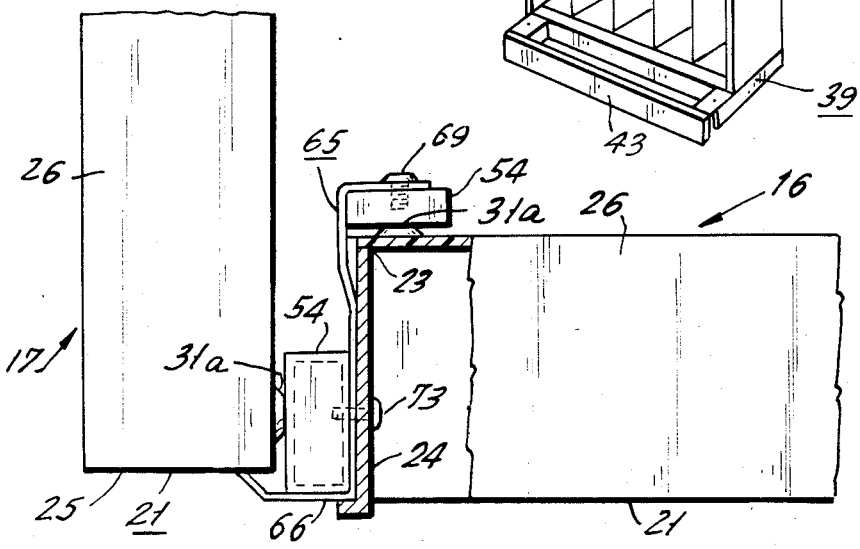
FIG. 7 is a fragmentary perspective looking at the upper end of a corner adapter and module elements connected directly thereto.

Now referring to the drawings in which FIG. 1 illustrates free standing display rack 10 which is a so called island of rectangular form constructed of eight factory built modules 11–18. Since all of the modules 11–18 are of substantially identical construction, only the construction of module 15 will be described with particular reference to FIGS. 3 and 4. That is, module 15 includes upper and lower rectangular pans 21 and 22, each of which includes main rectangular rear wall 23, vertical side walls 24 and 25 extending forward from the long edges of rear wall 23 and horizontal upper and lower walls 26 and 27, respectively, that extend forward from the short edges of rear wall 23. Rear wall 23 is provided with a plurality of T slots 28 which receive hook formations (not shown) that project from the rear of interior portion assembly 29 so that one such assembly may be mounted within each of the pans 21 and 22 in a manner known to the art. Rear wall 23 is also provided with four apertures 31 each of which is surrounded by a rearward extending embossment **31*a* (FIG. 7) for reason to be hereinafter explained. Two hinge assemblies 32 that secure header strip 33 to upper wall 26 of upper pan 21 permit header 33 to be pivoted upward about its upper edge 33*a* from its normal downwardly extending position of FIG. 3. Molded plastic pan 34 having triangular ends 36 rests on the top 26 of upper pan 21 and secured thereto by four screws 37**.

Module 15 also includes two plastic bumper elements 38 and 39 having respective straight bumpers 42 and 43 that are disposed slightly forward of the open fronts of pans 21 and 22. Bumper element 38 is sandwiched between pans 21 and 22 and is secured to the former by three screws 39, while lower bumper element 43 is secured to the bottom of pan 22 by three screws 41. Module 15 further includes metal frame constructed of tubular members of generally rectangular cross-section. In particular, frame 50 includes two L-shaped side members 51 that are connected to and spaced apart by three horizontal transverse members 52. The short horizontal legs 53 of main frame members 51 extend along the bottom of lower bumper element 39 and the long vertical legs 54 of main frame members 51 extend along the rear of module 15 adjacent the sides thereof. In particular, vertical legs 54 of main frame members 51 lie against embossments **31*a* that surround clearance apertures 31, and pans 21 and 22 are secured to frame 50 by screws that extend through pan apertures 31 and frame apertures 61. Plastic fillers 56 close the upper ends of tubular main frame elements 51. Each of the modules 11–18 is shipped from the factory in the assembled condition shown in FIG. 3**.

To form rack 10 the modules 11–18 are divided into four pairs and the modules of each pair, say modules 15, 16, are connected in a side-by-side array. Thus, modules 15 and 16 are secured together by three generally rectangular splice plates 55 that engage the vertical legs 54 of adjacent main frame elements 51, one from module 15 and the other from module 16. Screws 57 extend through two key hole slots 58 in splice member 55 and are received by threaded apertures in vertical section 54 of main frame members 51, thereby securing each of the splice elements 55 to frame 50.

In a similar manner, modules 17 and 18 are secured together in a side-by-side relationship, modules 11 and 12 are secured together in a side-by-side relationship and modules 13 and 14 are secured together in a side-by-side relationship. The array of modules 11 and 12 extend parallel to the array of modules 15 and 16 and are in back to back relationships with respect thereto. Similarly, the array of modules 13 and 14 is parallel to the array of modules 17 and 18 and is in spaced back to back relationship with respect thereto. Thus, the rear surfaces of modules 11–18 define a rectangular interior space that is covered by pyramid cap 59 having downward extensions (not shown) that are secured to some of the main frame members 51 at the upper ends thereof.

Figure 6:
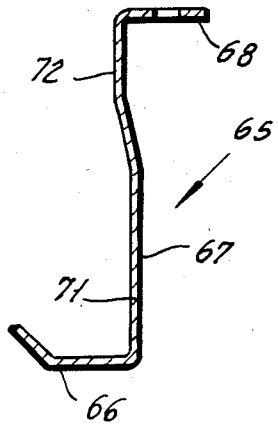
FIG. 6 is a transverse cross-section of a corner adapter.

Corner adapter 65 (FIGS. 6 and 7) is interposed between modules 16 and 17 with color section 66 of adapter 65 bridging the narrow vertical gap between side 24 of module 16 and rear wall 23 of module 17, and cover section 66 being generally coplanar with side 25 of module 17 and the open front of module 16. More particularly, corner adapter 15 is an elongated element whose length is approximately that of frame 50. Adapter 66 also includes connecting section 67, having cover section 66 at one end thereof and mounting section 68 at the other end thereof, with sections 66 and 68 extending in opposite direction from connecting section 67. Mounting section 68 is positioned adjacent the rear of frame portion 54 that is next to side 24 of module 16, with a plurality of screws 69 extending through clearance apertures 71 in connecting section 68 and being received by threaded apertures in frame section 54.

Main section 67 is slightly dog legged so as to comprise portion 71 that is connected directly to cover section 66 and portion 72 that is connected directly to mounting section 68. Connecting section 67 lies adjacent to side 24 of module 16 with portion 71 being sandwiched between side 24 and the rear of frame section 54 that lies adjacent to side 25 of module 17. A plurality of screws 73 extend through aligned clearance apertures in dogleg portion 71 and side 24 of module 16, and are received by threaded apertures in frame section 54 of module 17. In a similar manner an individual corner adapter 65 is interposed between modules 11 and 18, between modules 12 and 13 and between modules 14 and 15.

Figure 8:
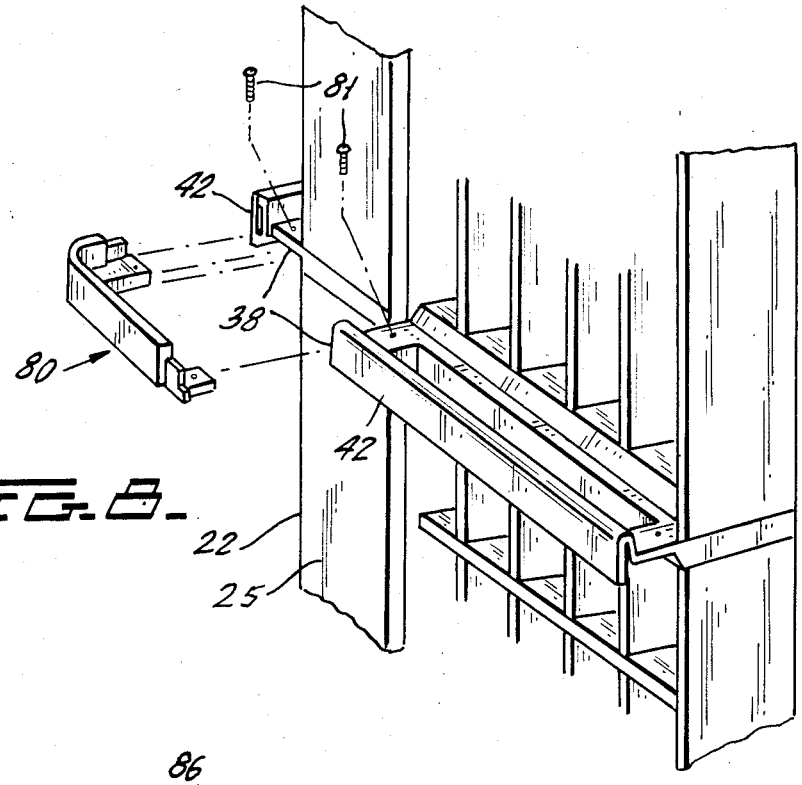
FIG. 8 is an exploded perspective of a corner bumper and fragmentary portions of bumper elements that are attached to opposite ends of the corner bumper.
Figure 9:
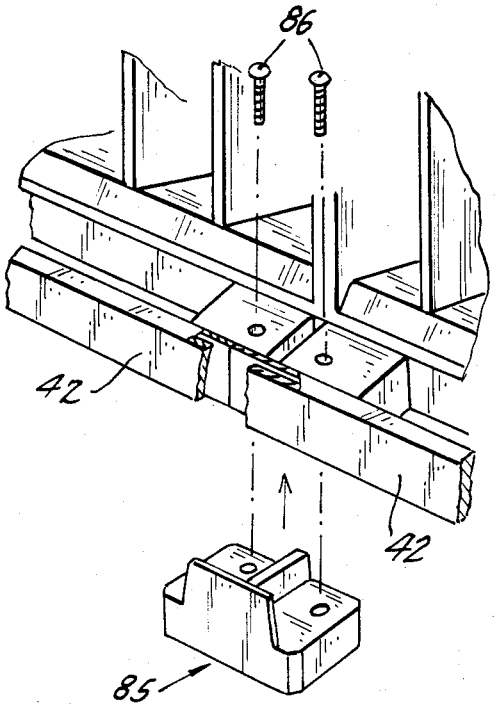
FIG. 9 is an exploded perspective of a connector for joining the ends of axially aligned bumpers.

Two screws 81 (FIG. 8) connect corner bumper element 80 to bumper elements 38 of modules 16 and 17 to close the gap between the ends of bumpers 42 for these elements 38. An individual corner bumper 80 is provided to bridge the corner gaps between bumpers 42 and to bridge the corner gaps between bumpers 43. The very slight gap between the ends of axially aligned bumpers 42 of side-by-side modules 15 and 16 is bridged by splice element 85 (FIG. 9) that is secured in place by screw 86, 86. Individual splice elements 85 perform the same function in connection with each pair of axially aligned bumpers 42 and 43. Thus, the bumper elements 38, corner bumpers 80 and splice elements 85 cooperate to form a continuous bumper that encircles stand 10 at a level approximately half the height of modules 11–18. Similarly, bumper elements 39, corner bumpers 80 and splice elements 85 cooperate to form a continuous bumper that encircles stand 10 at the bottom thereof.

A plurality (usually four) of leveling devices 90, two of which are visible in FIG. 1 are threadably mounted to selected main frame elements 51 near the free ends of their short horizontal sections 53.

While this invention has been described in connection with display stand 10 consisting of eight modules, 11–18 which form a rectangle having two modules on each side, it should now be apparent to those skilled in the art that by utilizing fewer or more of these modules other desirable rack configurations may be constructed. For instance, a rectangle may be constructed with one or more side-by-side modules forming two opposite sides and two or more side-by-side modules forming the other two sides. It is also possible to construct a rectangle in which each of its sides consists of a single module. Further, a stand may be constructed in a U-configuration as well as in an L-configuration. With these open sided configurations (L or U), one or more shelves may be placed within the area that is partially enclosed by the stand and this area may be covered by a roof similar to cap 59.

Figure 3:
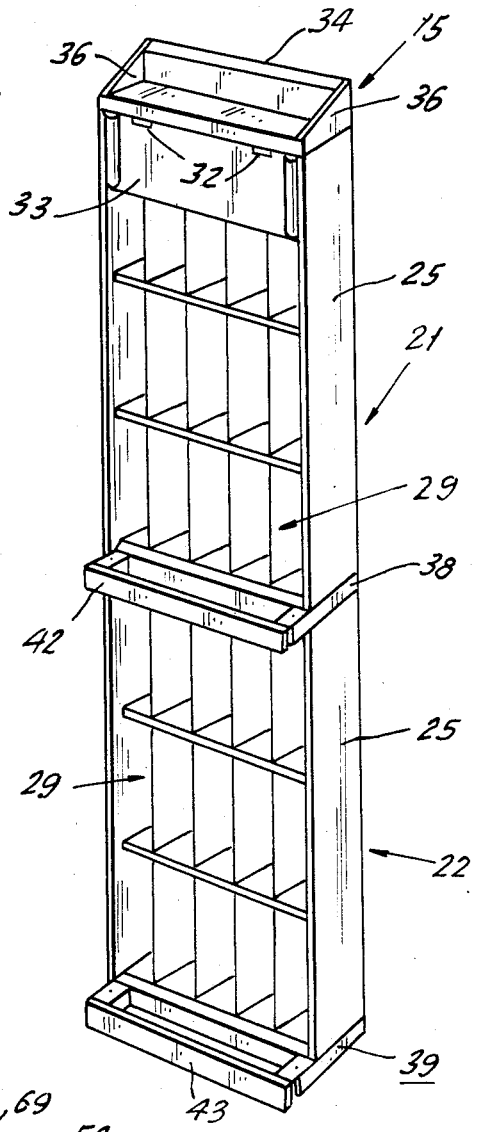
FIG. 3 is a perspective looking at the front of one of the modules that form the display stand of FIG. 1.
Figure 4:
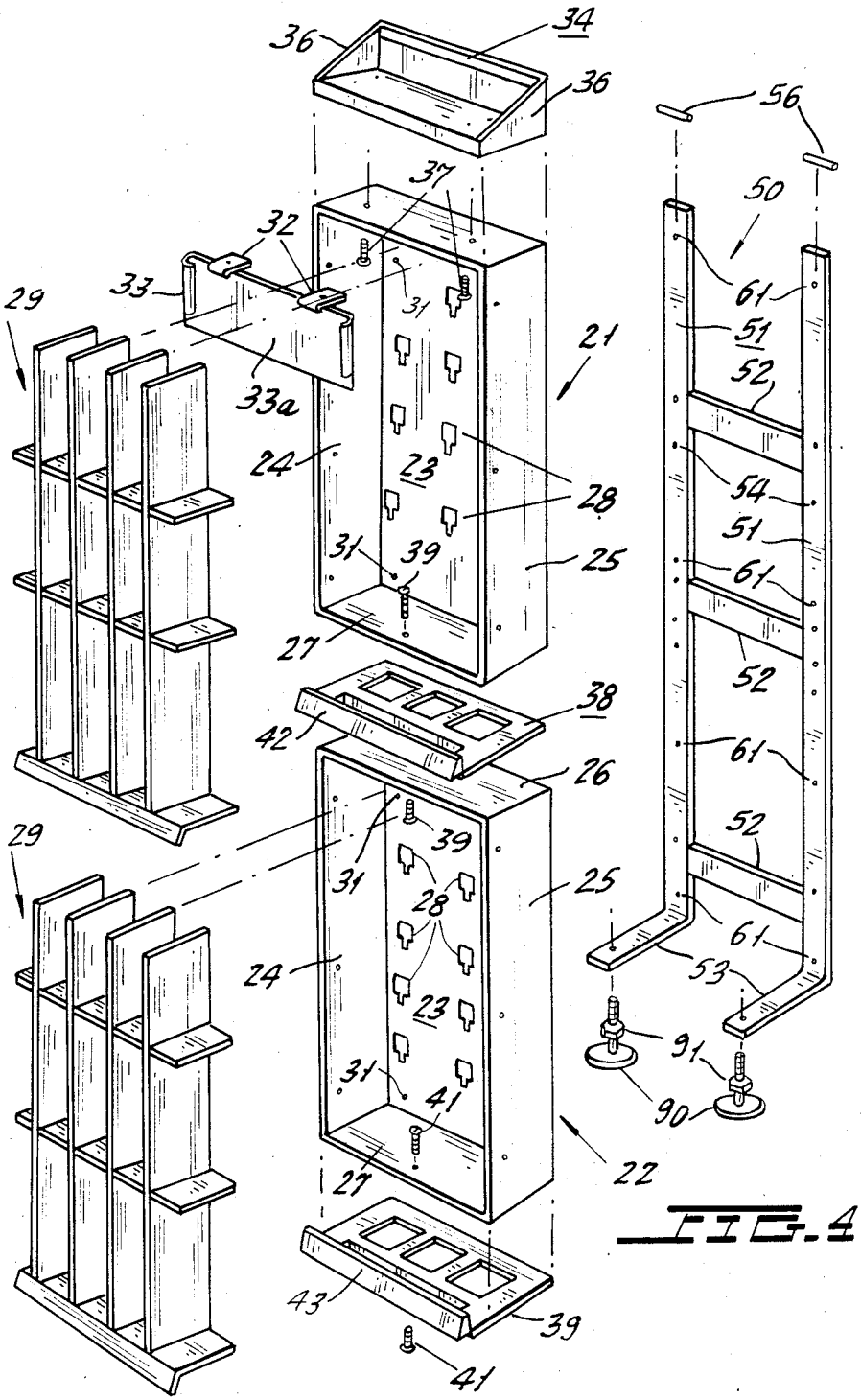
FIG. 4 is an exploded perspective of the module illustrated in FIG. 3.
Figure 5:
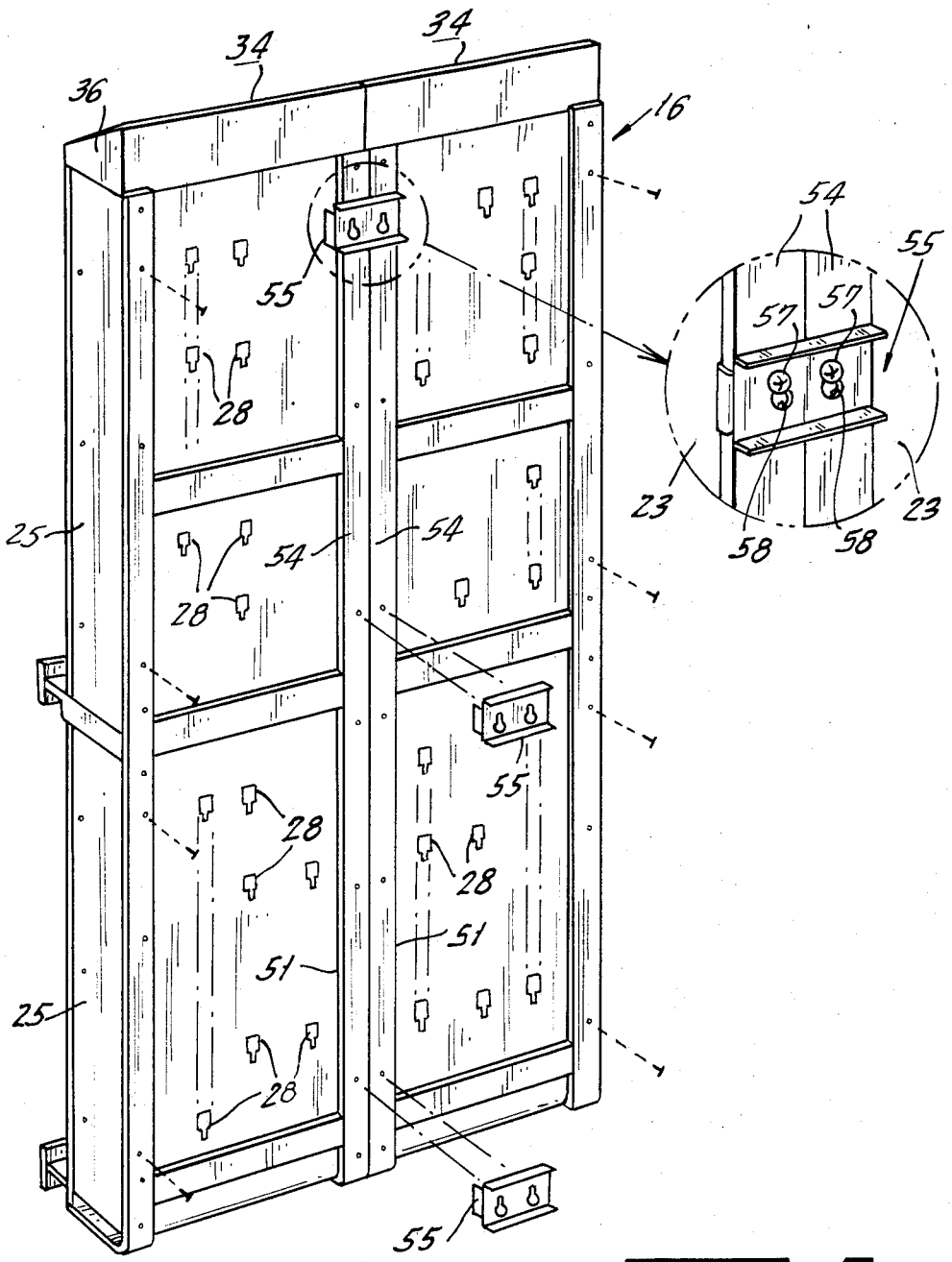
FIG. 5 is a perspective looking at the rear of two modules joined side-by-side.

Now it should also be apparent that the display stand of the instant invention is intended to be marketed in kit form, with a kit including a plurality of modules each assembled, for example as in FIG. 3 together with securing means or hardware (screws, etc.) for interconnecting the modules. Such kit will also include appropriate splice plates 55, corner bumpers 80, splice elements 85, corner adapters 65, leveling devices 90, headers 33, pans 34 and cap 59 to construct a desired stand configuration.

The present invention has been described in connection with preferred embodiments thereof. Since many variations and modifications will now become apparent to those skilled in the art, it is preferred that the present invention be limited not by the specific disclosure herein, but only by the appended claims.

What is claimed is:

1. A free standing display rack including:

first, second, third and fourth modules each having a generally closed rear, a generally open front and sides extending forward from opposite vertical side edges of said rear;

said first and second modules being secured together in sideways alignment, said third module having a side thereof positioned adjacent to said first module at its said rear with the front of said third module being generally coplanar with a side of said first module remote from said second module, and said fourth module having a side thereof positioned adjacent to said second module at its said rear with the front of the fourth module being generally coplanar with a side of said second module remote from said first module;

each of said modules including a first pan, a second pan positioned above said first pan and in vertical alignment therewith, a frame having a portion disposed at the rear of said module and having said first and second pans secured thereto.

2. A free standing display rack as set forth in claim 1, in which each of said modules also includes a bumper means sandwiched between its said first and said second pans and having a bumper disposed forwardly of said pans.

3. A free standing display rack as set forth in claim 1, in which each of said modules also includes a bumper means disposed below said first pan and having a bumper disposed forwardly thereof.

4. A free standing display rack as set forth in claim 2, in which each of said modules also includes another bumper means disposed below said first pan and having a bumper disposed forwardly thereof.

5. A free standing display rack as set forth in claim 1, in which said frame includes another portion that extends forwardly from said portion of said frame and below sad first pan.

6. A free standing display rack as set forth in claim 5, in which each of said modules also includes a bumper means disposed below said first pan and having a bumper disposed forwardly thereof; said bumper means being disposed between the first pan and said another portion of said frame.

7. A free standing display rack as set forth in claim 6, in which said frame includes generally parallel first and second members disposed near opposite sides of said module; each of said first and second members including a vertical section constituting said portion and a horizontal section constituting said another portion.

8. A free standing display rack as set forth in claim 7, in which each of said first and second members are tube elements.

9. A free standing display rack as set forth in claim 8, in which each of said tube elements has a horizontal cross-section which is generally rectangular in shape and having a width which is at least twice as great as its depth and extending parallel to the rear of said module.

10. A free standing display rack as set forth in claim 1, in which said frame includes generally parallel members disposed near opposite sides of said module;

a first corner adapter interposed between said first and third module, and having a vertical cover section that is generally coplanar with the front of said third module and bridges a narrow vertical gap between the pans of said first modules and the pans of said third module; and a second corner adapter interposed between said second and fourth modules, said second corner adapter having a vertical cover section that is generally coplanar with he front of the fourth module and bridges a narrow vertical gap between the pans of said second module and the pans of said fourth module.

11. A free standing display rack as set forth in claim 2, also including a first corner bumper horizontally aligned with bumpers of said first and third modules, and closing a gap between the ends thereof; and a second corner bumper horizontally aligned with bumpers of said second and fourth modules, and closing a gap between the ends thereof.

12. A free standing display rack as set forth in claim 3, also including a first corner bumper horizontally aligned with bumpers of said first and third modules, and closing a gap between the ends thereof; and a second corner bumper horizontally aligned with bumpers of said second and fourth modules, and closing a gap between the ends thereof.

13. A free standing display rack as set forth in claim 1, also including a fifth and a sixth module secured together in sideways alignment;

said first, second, third, fourth, fifth and sixth modules being identical insofar as the construction and mounting of the pans and frame comprising each of said modules;

said third module having another side thereof positioned adjacent said fifth module at its said rear with the front of the third module being generally coplanar with a side of said fifth module remote from said sixth module; and said fourth module having another side thereof positioned adjacent to said sixth module at its said rear with the front of the fourth module being generally coplanar with a side of said sixth module remote from said fifth module.

14. A free standing display rack as set forth in claim 1, also including a cover constituting a ceiling over an interior space which is defined by the cooperation of said modules.

15. A free standing display rack as set forth in claim 13, also including a cover constituting a ceiling over an interior space defined through cooperation of said modules and outside of each of them.

16. A free standing display rack as set forth in claim 1, in which the pans are molded plastic elements and the frame is constructed of metal.

17. A free standing display rack including:

first and second modules each having a generally closed rear, a generally open front and sides extending forward from opposite vertical side edges of said rear;

means securing said modules together with said rear of said first module being perpendicular to said rear of said second module;

each of said modules including a first pan, a second pan positioned above said first pan and in vertical alignment therewith, a frame having a portion disposed at the rear of said module and having said first and second pans secured thereto.

18. A free standing display rack as set forth in claim 17 in which a side of said second module having a side thereof positioned adjacent to said first module at its said rear with the front of said second module being generally coplanar with a side of said first module;

19. A free standing display rack as set forth in claim 18, in which said frame includes generally parallel members disposed near opposite sides of said module;

a first corner adapter interposed between said first and second modules, and having a vertical cover section that is generally coplanar with the front of said second module and bridges a narrow vertical gap between the pans of said first module and the pans of said second module.

20. A free standing display rack as set forth in claim 18, in which each of said modules also includes a bumper means disposed below said first pan and having a bumper disposed forwardly thereof.

21. A free standing display rack as set forth in claim 20, also including a first corner bumper horizontally aligned with bumpers of said first and second modules, and closing a gap between the ends thereof.

* * * * *